United States Patent [19]

Duncan

[11] 4,225,414

[45] Sep. 30, 1980

[54] PROCESS FOR HYDROCRACKING CARBONACEOUS MATERIAL TO PROVIDE FUELS OR CHEMICAL FEED STOCK

[75] Inventor: Dennis A. Duncan, Downers Grove, Ill.

[73] Assignee: The United States of America as represented by the United States Department of Energy, Washington, D.C.

[21] Appl. No.: 15,258

[22] Filed: Feb. 26, 1979

[51] Int. Cl.[2] ..... C10G 1/06; C07C 15/08; C07C 3/58

[52] U.S. Cl. ..... 208/8 R; 208/107; 585/469; 585/903; 585/911; 568/799

[58] Field of Search ..... 208/107, 8–11, 208/108–112, 263; 260/672 R, 672 NC; 585/476, 483, 488–489, 469, 903, 911

[56] References Cited

U.S. PATENT DOCUMENTS

| | | | |
|---|---|---|---|
| 1,876,007 | 9/1932 | Hupe | 585/476 X |
| 1,998,595 | 4/1935 | Speer et al. | 585/476 X |
| 2,819,322 | 1/1958 | Fetterly | 585/476 |
| 2,920,116 | 1/1960 | Riesz et al. | 585/476 X |
| 3,213,153 | 10/1965 | Mills | 585/476 |
| 3,284,513 | 11/1966 | Dedinas et al. | 585/488 X |
| 3,284,514 | 11/1966 | Dedinas et al. | 585/488 X |
| 3,303,222 | 2/1967 | Offutt | 585/488 X |
| 3,390,200 | 6/1968 | Sze | 585/476 |
| 3,623,973 | 11/1971 | Tarhan | 585/476 X |
| 3,794,579 | 2/1974 | Enomoto et al. | 208/40 |

*Primary Examiner*—Delbert E. Gantz
*Assistant Examiner*—G. E. Schmitkons
*Attorney, Agent, or Firm*—R. V. Lupo; Frank H. Jackson; Arthur A. Churm

[57] ABSTRACT

A process is disclosed for hydrocracking coal or other carbonaceous material to produce various aromatic hydrocarbons including benzene, toluene, xylene, ethylbenzene, phenol and cresols in variable relative concentrations while maintaining a near constant maximum temperature. Variations in relative aromatic concentrations are achieved by changing the kinetic severity of the hydrocracking reaction by altering the temperature profile up to and quenching from the final hydrocracking temperature. The relative concentration of benzene to the alkyl and hydroxyl aromatics is increased by imposing increased kinetic severity above that corresponding to constant heating rate followed by immediate quenching at about the same rate to below the temperature at which dehydroxylation and dealkylation reactions appreciably occur. Similarly phenols, cresols and xylenes are produced in enhanced concentrations by adjusting the temperature profile to provide a reduced kinetic severity relative to that employed when high benzene concentrations are desired. These variations in concentrations can be used to produce desired materials for chemical feed stocks or for fuels.

3 Claims, 9 Drawing Figures

PROFILE TYPE

- □ HIGH TEMPERATURE SOAK
- ● "UPSWEEP"
- ○ CONSTANT HEATING RATE
- △ INTERMEDIATE TEMPERATURE SOAK

PROCESS FOR HYDROCRACKING CARBONACEOUS MATERIAL TO PROVIDE FUELS OR CHEMICAL FEED STOCK

CONTRACTUAL ORIGIN OF THE INVENTION

The invention described herein was made in the course of, or under, a contract with the U.S. DEPARTMENT OF ENERGY.

BACKGROUND OF THE INVENTION

The present invention relates to processes for hydrocracking coal and other solid or liquid carbonaceous material. In such processes the carbonaceous material is heated to an elevated temperature of 1400°-1800° F. at pressures of 1500-2500 psi and contacted with hydrogen or other reducing gas to decompose large aromatic compounds to simpler hydrocarbons that can be conveyed as liquids or gases when used. Such processes produce a spectrum of products including alkanes and the aromatic compounds such as benzene, toluene, xylene, ethylbenzene, phenol and cresols. Although lignite and bituminous coal are important starting materials, various other solid and liquid carbonaceous materials including anthracite coal, wood, peat, oil shale, tar sand, lignin, solid and liquid petroleum residuals, and other related materials can be processed. In addition various liquids including anthracene, decalin, tars, bitumens, asphaltenes, condensed aromatics, derivatives of these materials, and other high boiling compounds may be advantageously processed by the method of this development.

Previous methods for hydrocracking high molecular weight carbonaceous materials have involved heating to an elevated temperature in the presence of hydrogen and maintaining the reactants at that temperature to produce lower molecular weight products. In most instances variation in the types of products and their relative concentrations was brought about by varying the reaction temperature at which the hydrocracking occurs. Such variations introduce difficult operating problems of managing heat balance requirements and waste heat recovery in plants that frequently change the spectrum of reaction products to meet different requirements such as for motor fuels or chemical feedstocks. For example a high concentration of phenol may be desirable in preparing a feedstock for phenolformaldehyde resins while other less odorous and deleterious aromatics such as benzene and xylenes may be desired for motor vehicle fuels. Research octane number (RON) is of considerable importance in preparing blending stock for internal combustion engine fuels. Solely from this consideration, phenols, cresols, xylenes, ethylbenzene and toluene are of considerable importance.

PRIOR ART STATEMENT

The following publications relate to the technical field of the subject invention but do not disclose or make obvious the invention as claimed.

Johnson, "Gasification of Montana Lignite in Hydrogen and in Helium During Initial Reaction Stages" *American Chemical Society, Division of Fuel Chemistry, Symposium on Structure and Reactivity of Coal and Tar,* Chicago, Ill. 1975. This presentation illustrates how the yield of heavy hydrocarbons including benzene vary with maximum temperature as well as with time temperature history. On pages 23 and 24 the variation in heavy hydrocarbon and benzene yield are shown for variations in maximum temperature with constant heat-up rate and with isothermal operating conditions as parameters. However, no disclosure is made as to how the relative concentrations of aromatic hydrocarbons such as benzene, phenols, xylenes and cresols can be varied while operating at a set maximum temperature.

Duncan, et. al FE-2307-2 "Research and Development of Rapid Hydrogenation for Coal Conversion to Synthetic Motor Fuels" USDOE, IGT 1976. This report on pages 7-9 illustrates linear and nonlinear profiles and suggests that yields and product distribution between gases, liquids and solids can be manipulated by changes in temperature profile. The report does not teach how the relative concentration of various aromatics can be altered by specific changes in temperature profile and kinetic severity.

Duncan, et. al FE-2307-21 "Research and Development of Rapid Hydrogenation for Coal Conversion to Synthetic Motor Fuels" Quarterly Report by the Institute of Gas Technology for U.S. Department of Energy, April to June 1977. This report on page 22 shows that the liquid fraction produced during the hydrocracking of coal includes substantial amounts of benzene, toluene, xylene and other high octane blending constituents. It is not suggested that the relative amounts of these components can be changed.

SUMMARY OF THE INVENTION

In view of the above discussion, it is an object of the present invention to provide a method of hydrocracking carbonaceous material in which the relative amounts of aromatic hydrocarbons can be varied.

It is a further object to provide a method of hydrocracking carbonaceous material at a set maximum temperature while varying the relative outputs of hydroxyl and alkyl aromatic hydrocarbons relative to benzene.

It is also an object to provide a method of hydrocracking carbonaceous material that can be easily altered to produce various aromatic feedstocks for chemical processing or for blending as high octane stock in motor vehicle fuels.

In accordance with the present invention a method of hydrocracking carbonaceous material in the presence of a hydrogen containing gas at a set maximum cracking temperature is performed by altering the time-temperature profile to change the kinetic severity and produce relative amounts of aromatic hydrocarbons including benzene, toluene, xylene, ethylbenzene, phenols and cresols.

In more specific aspects of the invention, the alkyl and hydroxyl aromatic hydrocarbons are increased relative to benzene by decreasing the kinetic severity to below that corresponding to the kinetic severity produced by a constant heating rate over the same interval. By the reverse procedure, the relative concentration of benzene in the product is increased. In one particular method of increasing the concentration of xylenes, cresols, phenol and ethylbenzene in respect to benzene, solid carbonaceous particles are entrained in a flow of hydrogen-containing gas and heated to produce a temperature increase at a continuously increasing rate until the maximum temperature is obtained. This is followed by immediately quenching to below the temperature at which the dealkylation and dehydroxylation reactions proceed toward increased benzene concentration.

BRIEF DESCRIPTION OF THE DRAWINGS

The present invention is described in the accompanying drawings wherein.

DETAILED DESCRIPTION OF THE PREFERRED EMBODIMENT

Figure 1:
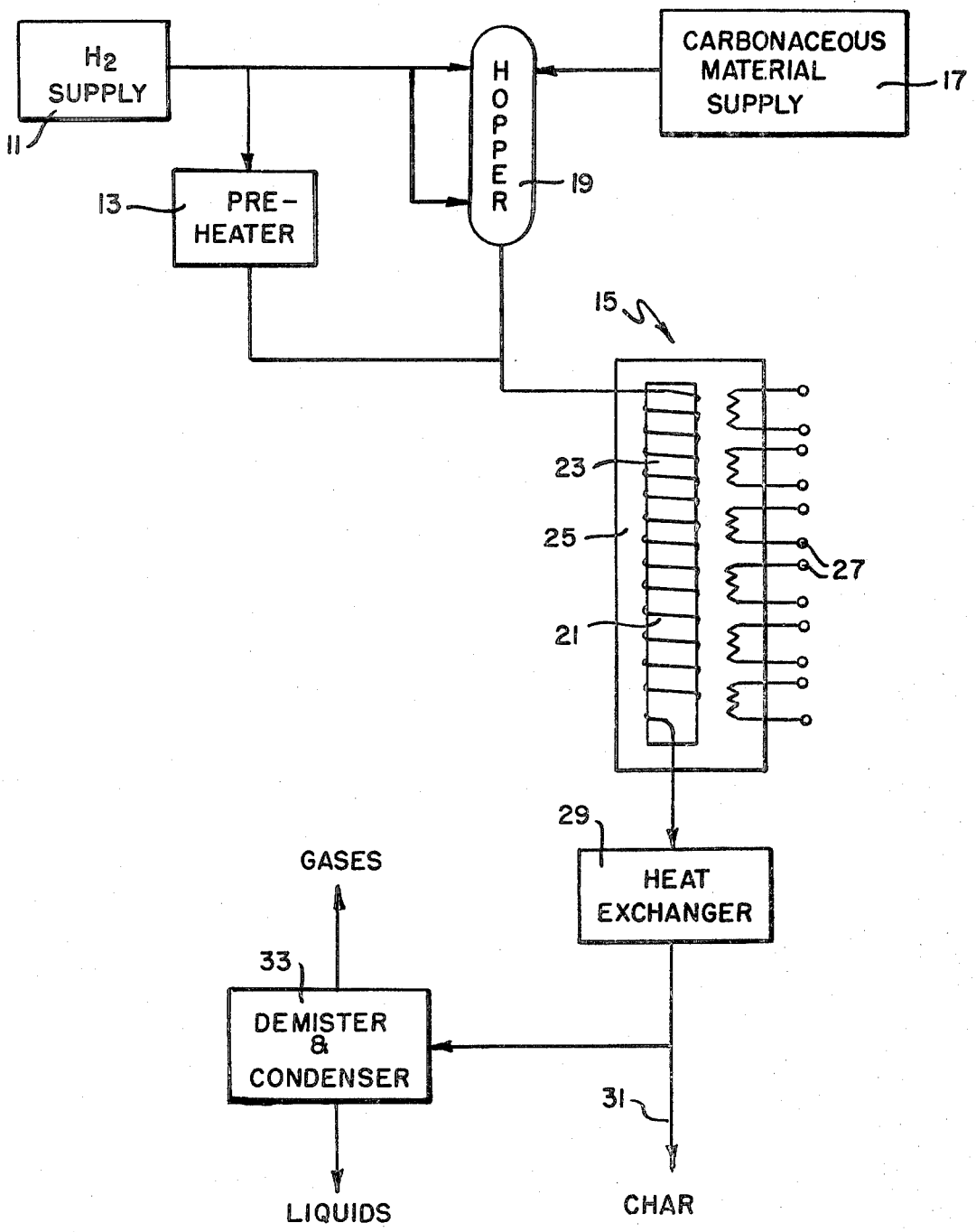
FIG. 1 is a flow diagram of a process for hydrocracking solid carbonaceous material.

One manner of carrying out the process of the present invention is illustrated in FIG. 1. For a clear presentation of the process, various components such as valves, pumps, traps for char and condensed material have been omitted. It will be clear to those skilled in the art that such components are to be included at suitable locations.

As illustrated a supply of a hydrogen-containing gas under pressure 11 can be passed through a preheater 13 before entering a reactor 15 where the hydrocracking of carbonaceous material occurs. The carbonaceous material from a supply 17 in a finely pulverized state is transferred to a hopper 19 where it is sufficiently fluidized to be entrained in the hydrogen-containing gas flow to the reactor 15.

The hydrogen-containing gas can be hydrogen, hydrogen mixed with a diluent gas, synthesis gas including hydrogen and carbon monoxide or a gas having components which will react to produce hydrogen such as a mixture of carbon monoxide and steam.

Reactor 15 is illustrated as a coiled tube 21 around a mandrel 23 passing through a furnace 25 containing a plurality of heating elements 27 along the length of the tube and mandrel. Each heating element 27 includes a separate monitoring and control system (not shown) for regulating the temperature and heat input at its corresponding portion of the reactor length.

Although an electrical furnace 25 and heating elements 27 were employed in bench scale tests of the present invention, it will be understood that various other control means for heating intervals of the reactor length can be employed. Heating elements 27 can be provided as burners, coils containing steam or other hot process fluids, as well as various other controlled sources of heat for varying the temperature profile of the entrained carbonaceous material during the hydrocracking process. One particularly suitable reactor design includes the controlled bleeding of oxygen gas into the flow of entrained carbonaceous material to permit small but controlled combustion at a plurality of points along the reactor coil. Such a reactor design is more fully described in the Assignee's co-pending patent application by Duncan et al, Ser. No. 015,257, filed Feb. 26, 1979, entitled "Reactor and Method for Hydrocracking Carbonaceous Material".

The mixture of gases produced in the hydrocracking reactor along with residual char are quenched in a suitable heat exchanger 29 followed by char removal at 31 and gas-liquid separation in a vessel 33 for demisting and condensing liquids from gases. In accordance with the present process, quenching is conducted to a sufficiently low temperature at which certain molecular fragmentation reactions no longer occur. For instance, an initial quench can be performed from a hydrocracking temperature of about 1500° F. to about 1200° F. or below at which temperature dealkylation and dehydroxylation reactions by aromatic compounds such as xylenes and phenols no longer occur to any appreciable extent to increased benzene concentration.

The heat exchanger 29 employed for quenching can be a cooling unit near reactor 15 where prompt quenching is required. Also an inert gas such as nitrogen can be injected into the outlet portion of reactor tube 21 to effect quenching. In large commercial applications it may be desirable to use an oil quench in combination with the demisting and condensing operations in vessel 33. The components employed for such quenching, demisting, and condensing operations can be conventional cyclone type separators within or in connection with a vessel receiving quench oil for contact with product gases.

One important advantage of the present invention is that in removing heat in both quenching and condensing of products, a set maximum temperature can be maintained from the reactor discharge while a variety of product distributions are achieved. This facilitates heat recovery operations adjunct to the quenching and condensing steps required in the process. Product compositions are altered by the changes in time-temperature profile up to a set maximum temperature rather than by altering the reactor outlet temperature.

Examples of various time-temperature profiles are illustrated in FIGS. 2*a* through 2*d*. These profiles were developed by actual operations on a bench scale hydrocracking process similar to that illustrated in FIG. 1. The reactor included about seventy feet of ⅛ inch tubing in the furnace for the heating portion of the profile and several feet of exposed tubing for carrying out the initial quench. Gas flows at 10–70 feet per second were provided. A maximum temperature of 1450°–1500° F. was used with quenching to a temperature at or below about 1200° F. Additional data including the product compositions of the runs illustrated in FIGS. 2*a* through 2*d* are shown in Table I. In this table hydrogen feed is given as a weight percent of the coal feed on a moisture and ash free (MAF) basis.

TABLE I

| | | Run No. | | | | | | | | |
|---|---|---|---|---|---|---|---|---|---|---|
| | | TP-1 | TP-2 | TP-3 | TP-4 | TP-5 | TP-6 | TP-8 | TP-10 | TP-11 |
| Systems Outlet Pressure, psig | | 2000 | 2000 | 2000 | 2000 | 2000 | 2000 | 2000 | 2000 | 1500 |
| Hydrogen Feed, wt % MAF feed | | 87.5 | 39.0 | 57.0 | 41.9 | 29.8 | 43.9 | 31.9 | 23.3 | 29.2 |
| Hydrogen Partial Pressure, psi | | 1757 | 1647 | 1748 | 1667 | 1505 | 1629 | 1595 | 1559 | 1197 |
| Maximum Temperature, °F. | | 1475 | 1500 | 1500 | 1500 | 1475 | 1450 | 1500 | 1500 | 1500 |
| Composition, wt % | Research Octane | | | | | | | | | |
| Benzene | 110 | 86.5 | 47.0 | 47.7 | 63.4 | 75.2 | 72.0 | 4.5 | 10.3 | 5.8 |
| Toluene | 124 | 2.8 | 27.0 | 11.5 | 18.0 | 15.7 | 21.0 | 11.2 | 10.8 | 11.9 |
| Ethylbenzene | 124 | — | 0.8 | 0.8 | 0.2 | 0.2 | 0.1 | 2.2 | 2.0 | 2.7 |
| Xylene | 139 | — | 2.8 | 3.3 | 0.8 | 0.4 | 0.4 | 7.8 | 7.1 | 8.7 |
| C9 Aromatics | Use 110 | 0.0 | 0.4 | 0.3 | 0.1 | 0.1 | 0.1 | 3.6 | 3.7 | 4.3 |

TABLE I-continued

| | | Run No. | | | | | | | | |
|---|---|---|---|---|---|---|---|---|---|---|
| | | TP-1 | TP-2 | TP-3 | TP-4 | TP-5 | TP-6 | TP-8 | TP-10 | TP-11 |
| Naphthalene | 90 | 6.1 | 6.9 | 17.8 | 7.2 | 2.8 | 2.9 | 10.2 | 7.9 | 9.3 |
| Methylnaphthalene | 105 | 0.1 | 0.3 | 1.0 | 0.2 | 0.0 | 0.1 | 1.4 | 1.9 | 0.7 |
| Phenol | 139.8 | 4.0 | 11.8 | 10.6 | 6.4 | 4.0 | 2.5 | 31.9 | 27.4 | 29.2 |
| Cresols | 149.4 | 0.0 | 1.1 | 1.7 | 0.6 | 0.1 | 0.0 | 17.6 | 18.1 | 14.9 |
| Unidentified | Use 90 | 0.1 | 1.6 | 2.3 | 1.9 | 0.6 | 0.2 | 1.9 | 2.2 | 3.0 |
| Unlisted | Use 90 | 0.4 | 0.3 | 3.0 | 1.2 | 0.9 | 0.7 | 7.7 | 8.6 | 9.5 |
| Total | | 100.0 | 100.0 | 100.0 | 100.0 | 100.0 | 100.0 | 100.0 | 100.0 | 100.0 |
| Research Octane Number (RON) | | 106.8 | 116.9 | 111.8 | 112.8 | 112.7 | 113.1 | 125.1 | 125.4 | 124.7 |
| RON After Hydrotreating | | 105.6 | 113.1 | 108.2 | 110.8 | 111.5 | 112.3 | 111.1 | 112.6 | 112.2 |

Figure 2A:
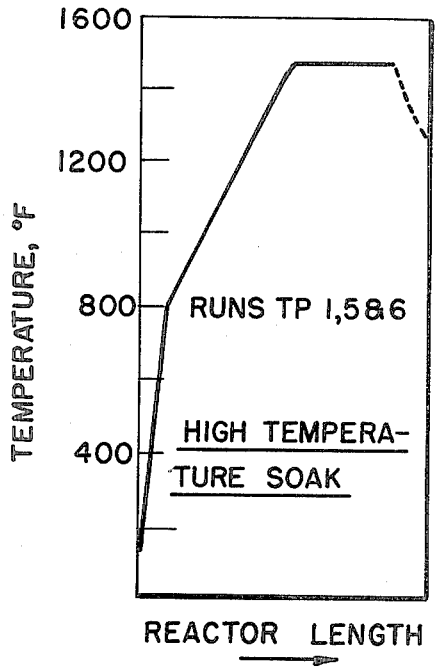
FIGS. 2*a*–2*d* are graphs illustrating various temperature profiles for a hydrocracking reactor.

FIG. 2*a* illustrates a temperature profile for a high temperature soak operation. This reactor operation is the one normally selected for a hydrocracking process as it includes a essentially constant heating rate from a preheat temperature of 800° F.–1200° F. to a final hydrocracking temperature which is maintained for a sufficient period of time to accomplish conversion of the solid material to lower molecular weight hydrocarbons. In the bench scale operations this soaking was carried out over about 1/10 to ¼ of the reactor length.

Figure 2B:
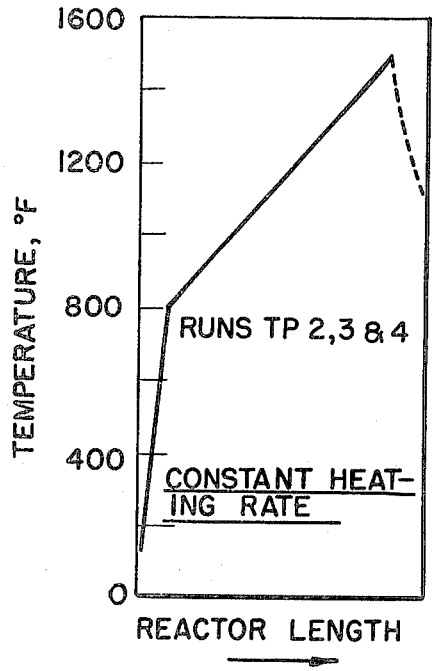

In FIG. 2*b* a temperature profile showing a constant heating rate to the maximum hydrocracking temperature followed by a rapid quench. In such a temperature profile quenching begins immediately with no more than about a 0.1 second delay at the maximum temperature. As will be seen this profile appears to provide kinetic severity at an intermediate level with moderate amounts of each of the various aromatic hydrocarbons e.g. benzene, toluene, xylene, ethylbenzene, phenols and cresols.

Figure 2C:
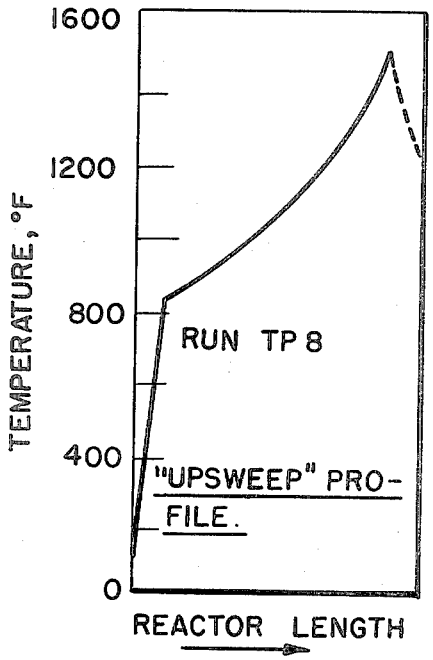

FIG. 2*c* illustrates an upsweep temperature profile in which the rate of temperature increase is increased throughout most of the reactor length. This profile minimumizes the time at the higher temperatures to reduce kinetic severity. Quenching begins with no more than a 0.1 second residence time at the maximum temperature.

Figure 2D:
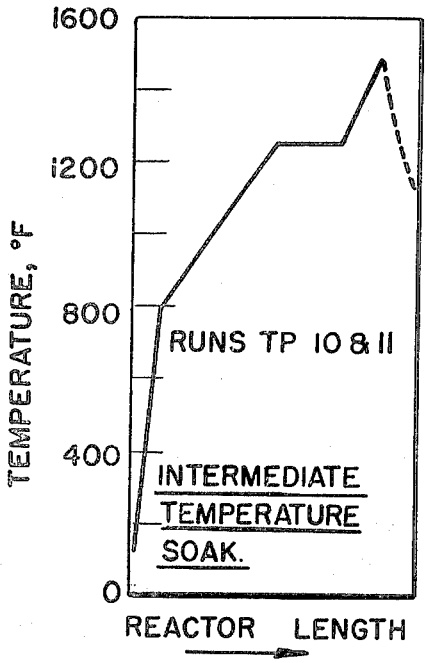
Figures 3A, 3B, 3C, 3D:
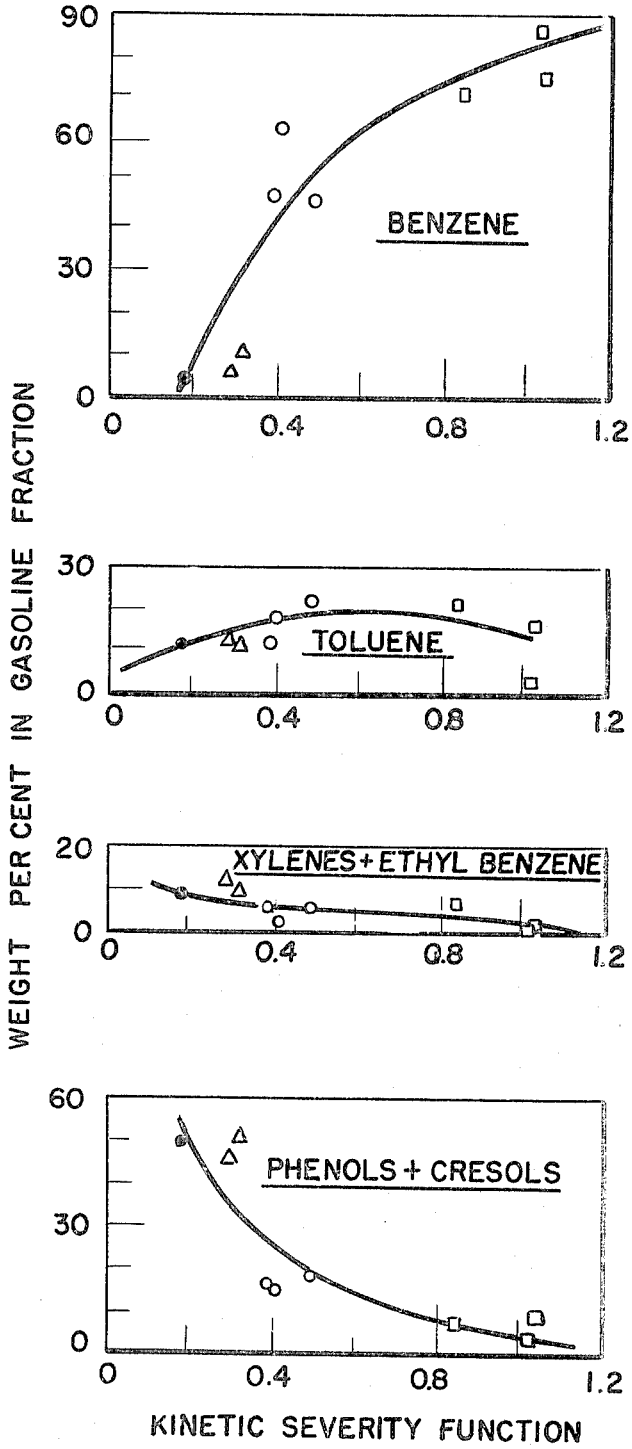
FIGS. 3*a*–3*d* are graphs showing relative concentrations of various aromatics verses kinetic severity function.

Likewise FIG. 2*d* permits hydrocracking at somewhat reduced kinetic severity while maintaining substantially the same reactor maximum temperature by employing an intermediate temperature soak. The intermediate temperature soak is shown at about 1225° F. which has been found to be below the temperature e.g.1250° F. at which rapid dealkylation and dehydroxylation reactions occur. The soak was performed at least for a reactor residence time of 1 second. This provides a relatively low kinetic severity for the reaction and thereby provides increased yields of phenols, cresols, xylenes, and ethylbenzene.

Of the various runs shown in Table I, runs TP 1, 5 and 6 correspond to the high temperature soak of FIG. 2*a*, runs TP 2, 3 and 4 correspond to the constant heating rate of FIG. 2*b*, run 8 corresponds to the upsweep temperature profile of FIG. 2*c*, and runs 10 and 11 were produced using the intermediate temperature soak profile of FIG. 2*d*. Of these runs it is seen that the concentration of cresols, phenols and xylenes which exhibit high research octane number are enhanced in the upsweep and intermediate temperature soak profiles of FIG. 2*c* and 2*d*.

In order to correlate more clearly these results FIGS. 3*a*, 3*b*, 3*c* and 3*d* are presented showing the relative concentrations of benzene, toluene, xylene, ethylbenzene, phenols and cresols as a function of kinetic severity. In these figures the kinetic severity is determined as the function $\int$ kdt, where t=time and k varies with temperature in accordance with the Arrhenius equation $k=A\exp(-E/RT)$ where:

A=Frequency Factor (1/time)
E=Activation Energy (Energy/mole)
R=Gas Constant (Energy/mole T)
T=Degrees Absolute Temperature The relationship of temperature to time is found from the selected temperature profiles where in many cases such as those illustrated a graphical solution is necessary to determine the kinetic severity function, $\int$ kdt. The graphs of FIGS. 3*a* through 3*b* were prepared by selecting the values of activation energy (E) and frequency factor (A) for anthracene as an approximation of the values applicable to coal.

It is therefore seen from an examination of FIGS. 3*a* through 3*d* that high kinetic severity increases the relative amount of benzene in respect to phenol and that such can be accomplished by selecting reactor processes characterized by the high temperature soak profile of FIG. 2*a*. It should be noted that this increased kinetic severity is obtained even though the maximum reactor temperatures are somewhat lower e.g. 1475°and 1450° F. than those employed for the upsweep profile and intermediate soak profile e.g. 1500° F.

It is also seen from FIGS. 3*a* through 3*d* that increased amounts of phenols, cresols and xylenes relative to benzene can be produced by the reduced kinetic severity accompanying the upsweep and intermediate temperature soak profiles of FIG. 2*c* and 2*d*. Moderate kinetic severity produced by the constant heating rate of FIG. 2*b* appears to produce intermediate quantities of each of the aromatic materials.

Therefore, from the above it is seen that a method is provided for hydrocracking carbonaceous material in which the relative amounts of aromatic hydrocarbons are varied by changing time-temperature profiles up to substantially equal maximum temperatures. The profiles are changed in a manner to reduce kinetic severity for the increased production of cresols, phenols, and xylenes and to increase kinetic severity for the increased production of benzene. The process offers the advantage of operating a reactor at a set maximum outlet temperature for producing various chemical feed stocks and fuels such that heat recovery processes operating with the reactor can be operated in uniform manner over a wide range of product discharge.

It will be clear that various changes can be made in the components, materials and process steps of the present invention within the scope of the accompanying claims.

The embodiments of the invention in which an exclusive property or privilege is claimed are defined as follows:

1. A method of hydrocracking particulate coal entrained in a flow of hydrogen-containing gas having a hydrogen partial pressure of 1000–2000 psig to produce benzene, toluene, xylenes, ethylbenzene, phenols and cresols, comprising heating said entrained flow from about 800° F. to a maximum hydrocracking temperature in the range of 1400°–1600° F. at a continuously increasing rate of temperature increase followed by a temperature quench at a rate at least as great as the rate of temperature increase over the corresponding temperature increments to enhance production of phenols, cresols, xylenes, and ethylbenzene, and to diminish production of benzene.

2. The method of claim 1 wherein said maximum hydrocracking temperature is about 1500° F. and said quenching continues to a temperature below about 1200° F.

3. The method of claim 1 wherein said maximum hydrocracking temperature is maintained for no more than a residence time of 0.1 seconds prior to quenching, said quenching continuing to a temperature below that at which substantial dealkylation and dehydroxylation towards increased benzene concentration occurs.

* * * * *